US008757953B2

(12) United States Patent
Fields et al.

(10) Patent No.: US 8,757,953 B2
(45) Date of Patent: Jun. 24, 2014

(54) DOUBLE SEAMING CHUCK-KNOCKOUT

(75) Inventors: Brian Fields, Lemont, IL (US); Richard Mark Orlando Golding, Mount Prospect, IL (US); Carlos Andres Mejia-Quinchia, Schaumburg, IL (US)

(73) Assignee: Crown Packaging Technology, Inc., Alsip, IL (US)

( * ) Notice: Subject to any disclaimer, the term of this patent is extended or adjusted under 35 U.S.C. 154(b) by 674 days.

(21) Appl. No.: 12/498,861

(22) Filed: Jul. 7, 2009

(65) Prior Publication Data

US 2011/0008134 A1 Jan. 13, 2011

(51) Int. Cl.
*B21D 51/30* (2006.01)

(52) U.S. Cl.
USPC ..... 413/2; 413/35

(58) Field of Classification Search
USPC ..... 413/2, 4, 26, 27, 74, 75, 6, 31, 35, 40, 413/43
See application file for complete search history.

(56) References Cited

U.S. PATENT DOCUMENTS

| | | | | |
|---|---|---|---|---|
| 4,470,738 | A | 9/1984 | Togo et al. | |
| 4,961,300 | A * | 10/1990 | Mihara et al. | 53/340 |
| 5,533,853 | A | 7/1996 | Wu | |
| 5,813,812 | A | 9/1998 | Moran et al. | |
| 5,957,647 | A * | 9/1999 | Hinton | 413/4 |
| 6,065,634 | A | 5/2000 | Brifcani et al. | |
| 6,105,341 | A * | 8/2000 | Campbell | 53/432 |
| 6,516,968 | B2 | 2/2003 | Stodd | |
| 6,561,004 | B1 * | 5/2003 | Neiner et al. | 72/715 |
| 6,702,142 | B2 | 3/2004 | Neiner | |
| 7,350,392 | B2 | 4/2008 | Turner et al. | |
| 7,399,152 | B2 | 7/2008 | Domijan | |
| 2002/0081172 | A1 | 6/2002 | Wu | |

* cited by examiner

*Primary Examiner* — Shelley Self
*Assistant Examiner* — Matthew G Katcoff
(74) *Attorney, Agent, or Firm* — Baker & Hostetler LLP

(57) ABSTRACT

A chuck-knockout assembly for seaming a can end onto a can body to form a seamed container is disclosed. The chuck-knockout assembly may include an upper chuck body and a lower chuck body. The upper chuck body may include a first drive surface and may be rotatably coupled to a seaming machine frame. The lower chuck body may include a second drive surface and may be longitudinally moveable relative to the upper chuck body. The second drive surface may be configured to engage a periphery of the can end during seaming and disengagement of the container.

20 Claims, 7 Drawing Sheets

DOUBLE SEAMING CHUCK-KNOCKOUT

TECHNICAL FIELD

The present technology relates to manufacturing of metal packaging. More particularly, the invention relates to an apparatus and methods for assembling a container and can end.

BACKGROUND

In the field of metal packaging, typical containers are sealed by seaming a can end onto a can body using the well-known double seaming process. The double seaming process is typically performed on a seaming machine having a plurality of forming stations. Each station contains a rotatable seaming chuck that acts as an anvil to support the can end while two rotatable seaming rolls are brought into contact with the container using a cam motion. The two seaming rolls define specific groove geometries that are configured to form a portion of the can body and a portion of the can end into a commercially acceptable double seam.

A can body is typically raised into engagement with a forming station using a lifter plate or other positioning mechanism. After the double seam is formed and the positioning mechanism is retracted, the sealed container is ejected from the station so the seam-forming cycle can be repeated on another container. Typically, ejection of the seamed container may be achieved by the use of a knockout rod or pad that taps the center of the container to knock the container out of engagement the seaming chuck.

A trend in beverage cans has been toward reduced end diameters. Further, many conventional beverage can ends have a small center panel diameter relative to a seaming panel or peripheral curl diameter. For example, U.S. Pat. Nos. 6,065,634, 6,702,142, 6,516,968 and 7,350,392, each of which is incorporated by reference in its entirety, disclose beverage can ends having a relatively small center panel because the chuck wall is inclined (as measured from an upper point to a lower point of the chuck wall).

The conventional design of knockout pad and seaming chuck is such that the seaming chuck locates the can end. Thus, conventional knockout pads typically fit inside the diameter of the surface of the chuck that contacts the can end, which leaves a certain amount of radial movement between the can end and the knockout prior to engagement with the seaming chuck. With certain end designs (i.e. lightweight ends) the countersink is moved inboard and with the traditional design of knockout, the radial movement available to the can end prior to engagement with the seaming chuck is increased. This radial movement is a result of the knockout not having a feature that locates and controls the end concentric with the rotatable seaming chuck. With this radial movement comes the opportunity for misalignment on assembly with the seaming chuck (during what's called the transition zone) which may cause collapse, creases and poor seam quality.

Furthermore, after conventional knockouts have located a can end, the load applied to the can end decreases to zero during the transition zone. Therefore, by the time the can body and can end engage the chuck, the can end and can body combination could be misaligned to the chuck, thereby causing damage to the can bodies and can ends. To prevent damage, often times certain seamers have to run at slower speeds such as less than 1500 cans/minute.

Accordingly, there is a need for an improved apparatus and method for locating and seaming a can end onto a can body.

SUMMARY

A chuck-knockout assembly that (among other things) gives improved location of a can end during the seaming operation (i.e. at least during the transition zone). Such improvements may be achieved by utilizing some or all of the features of the chuck-knockout assemblies described below.

In one embodiment, a chuck-knockout assembly for seaming a can end onto a can body to form a seamed container may include an upper chuck body and a lower chuck body. The upper chuck body may include a first drive surface. The first drive surface may at least partially define a seaming surface for contacting a portion of the can end during seaming and against which a seaming force is applied. The lower chuck body is longitudinally moveable relative to the upper chuck body and includes a second drive surface. The second drive surface may be located outboard of a periphery of a center panel of the can end. The second drive surface may be capable of locating the can end prior to seaming, may be capable of maintaining the can end during seaming and may also be capable of contacting the can end to disengage the can end from the chuck-knockout assembly after seaming.

The second drive surface of the lower chuck body may be configured to engage a countersink of the can end. Furthermore, the can end may comprise a pull tab, and the lower chuck body may be configured to be devoid of contact with the pull tab during the seaming and release.

A seaming system for seaming and release of a container including a can end and a can body is also provided. The seaming system may comprise a chuck-knockout assembly and first and second seaming rolls. The chuck-knockout assembly may include an upper chuck body and a lower chuck body. The upper chuck body may include a first drive surface, and may be rotatably coupled to a seaming machine frame. The lower chuck body may include a second drive surface, and may be longitudinally moveable relative to the upper chuck body. The first and second seaming rolls may be configured to form a seam on the container between the can end and the can body. The first drive surface and the second drive surface may define a seaming surface when the seam is being formed. The second drive surface may contact an outer periphery of the can end during release of the container from the chuck-knockout assembly.

A method of seaming a container including a can end and a can body is also disclosed. The method may comprise the steps of (1) providing a chuck-knockout assembly comprising an upper chuck body and a lower chuck body; (2) locating a can end from an infeed mechanism onto the chuck-knockout assembly such that a second drive surface of the lower chuck body is in contact with a periphery of the can end; (3) seaming the can end to a can body to form a container while the second drive surface is in contact with the periphery of the can end; and (4) releasing the container from the chuck-knockout assembly by moving the lower chuck body longitudinally relative to the upper chuck body, the lower chuck body moving from a seaming position to a knockout position, wherein the second drive surface is in contact with the periphery of the can end as the lower chuck body is moving to the knockout position.

In another embodiment a chuck-knockout assembly may utilize a vacuum force to locate the can end. For example, a chuck-knockout assembly may include a chuck body having an aperture and a first drive surface that at least partially defines a seaming surface for contacting a portion of the can end during seaming and against which a seaming force may be applied. A vacuum force may be applied through the aperture to locate the can end onto the chuck body prior to seaming and may hold the can end during seaming.

By using chuck-knockout assemblies that provide improved location of can ends certain seamers may be operated at higher speeds. The improved location may among other things be as a result of sufficient loads being applied to the can end and can body combinations during at least a majority of the transition zone. Therefore a method of seaming a can end onto a can body to form a container, may include (1) positioning the can end on top of the can body; (2) lifting the can body and can end combination with a lifter plate; (3) locating the can end with a chuck-knockout assembly such that the can body and can end combination is between the lifter plate and the chuck-knockout assembly; (4) maintaining a load that is between 15 and 100 lbf on the can body and can end combination for at least part of the transition zone; and (5) seaming the can end onto the can body during a first seaming operation. Preferably the load in the transition zone is maintained between about 30 lbf and about 38 lbf and even more preferably at about 35 lbf.

These and various other advantages and features are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there are illustrated and described preferred embodiments of the invention.

DETAILED DESCRIPTION OF ILLUSTRATIVE EMBODIMENTS

Preferred structures and methods for container seaming technology are described herein. An embodiment of a seaming system and chuck-knockout assembly that employ this technology are also described. The present invention is not limited to any particular seaming configuration but rather encompasses use in any container seaming application. Further, the present invention encompasses other seaming system and container designs not described herein.

Figure 1:
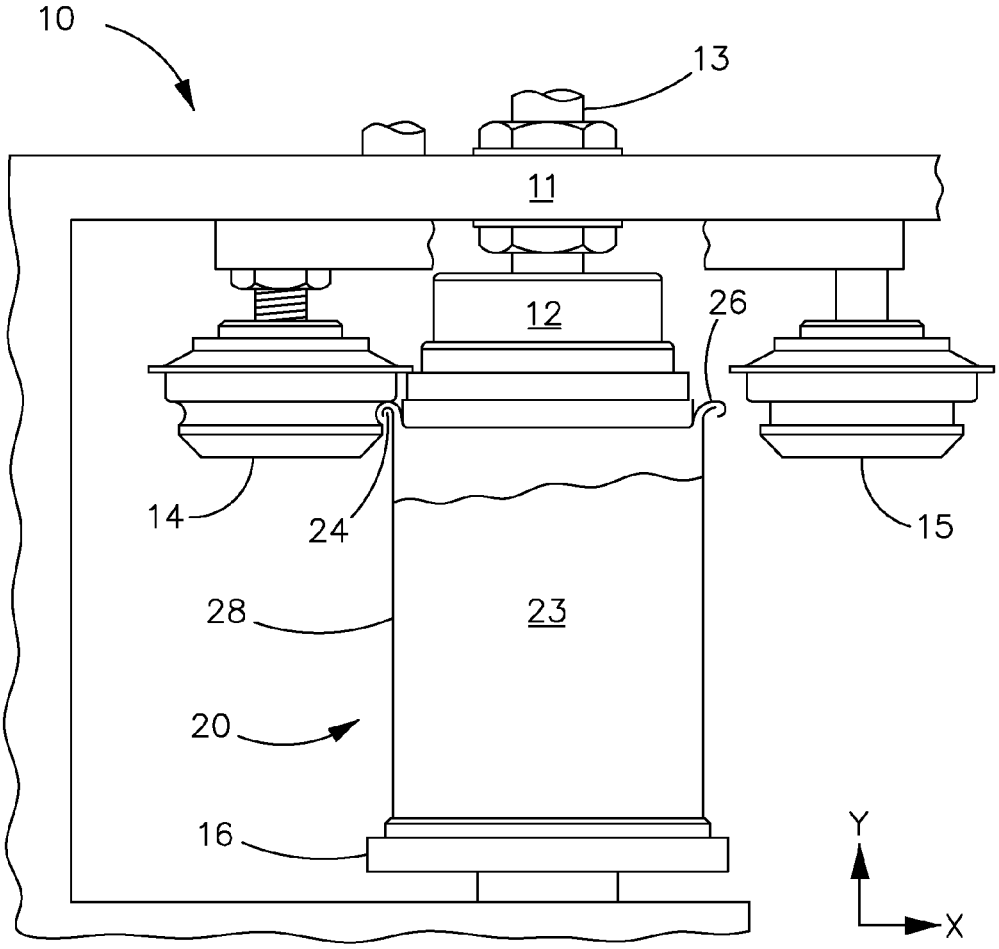
FIG. 1 is a side cross-sectional view of a seaming system seaming a can end onto a can body.

Referring to FIG. 1, a seaming system 10 includes a seaming machine frame 11, a chuck-knockout assembly 12 (including a knockout and a chuck), a first seaming roll 14, and a second seaming roll 15. Seaming machine frame 11 includes a shaft 13 for rotating chuck-knockout assembly 12 and a lifter plate 16 for lifting a container 20 containing a product 23 into engagement with chuck-knockout assembly 12. Chuck-knockout assembly 12 is affixed to shaft 13 and rotatably coupled to seaming machine frame 11. First seaming roll 14 and second seaming roll 15 are configured to form a double seam 24 in container 20 that seals a can end 26 onto a can body 28 via a seaming process that is known in the art (e.g., bending a curl portion of can end 26 around the top edge of can body 28).

Figure 2:
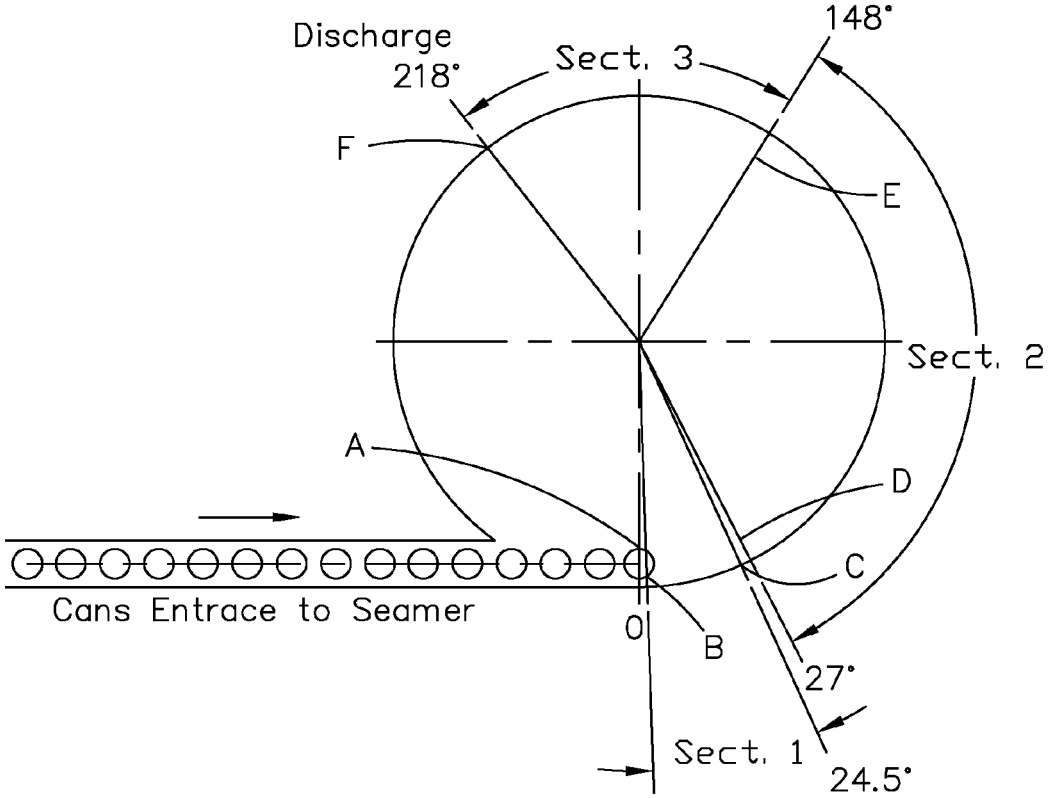
FIG. 2 is a schematic showing a seaming operation.

FIG. 2 is a schematic showing the seaming operation. First, a can body and can end enter the seamer at point A. At point B which may be approximately 1 degree from point A, the can body picks up the can end. At this point, the knockout makes contact with and locates the can end and can body combination. From point B to point C is known as the transition zone. The can end engages the chuck at point C which is about 24.5 degrees from point A. At point D, which is about 27 degrees from point A the first seaming operation begins and at point E, which is about 148 degrees from point A the second seaming operation begins. The can body and can end combination is then discharged at point F which is about 218 degrees from point A.

During the seaming operations, chuck-knockout assembly 12 may be rotated by shaft 13 or a seaming head or spindle (not shown) attached to shaft 13 about an axis indicated by arrow Y in FIG. 1. First seaming roll 14 and second seaming roll 15 may be brought into contact with container 20 (typically using a cam motion), and first seaming roll 14 and second seaming roll 15 may be rotated about an axis also indicated by arrow Y. Chuck-knockout assembly 12 may support one or more surfaces of can end 26 while first seaming roll 14 and second seaming roll 15 apply a force (generally directed radially inward) to container 20 to form double seam 24.

After seaming, lifter plate 16 may be lowered, and a portion of chuck-knockout assembly 12 may push against can end 26 to eject or release container 20 from chuck-knockout assembly 12. The seaming cycle may then be repeated to form double seam 24 on another container 20.

Seaming system 10 may typically form a double seam 24 on a variety of types of containers 20. A typical container 20 may contain or be configured to contain product 23, including a beverage, ready meals, fruits, vegetables, fish, dairy, pet food, or any other product that it is desirable to store in metal packaging such as container 20. Container 20 may have any length, diameter, wall thickness, and volume. Container 20 typically has a standard-sized interior volume that is known in the art for containing product 23 such as a beverage, ready meals, fruits, vegetables, fish, dairy, or pet food.

Container 20, including can end 26 and a can body 28 may be made from any material, for example, steel, aluminum, or tin plate. Can end 26 may include an approximately planar panel that may be formed, pressed, and/or stamped to take a shape that may include several features. Can end 26 may include an openable panel portion (not shown) that extends over a portion or most of can end 26, and the openable panel may be opened by breaking a score (not shown) to create an aperture (not shown) through which a user may remove product 23. Can end 26 may include a pull tab (not shown) to allow a user to open the openable panel portion to remove product 23.

Figure 3B:
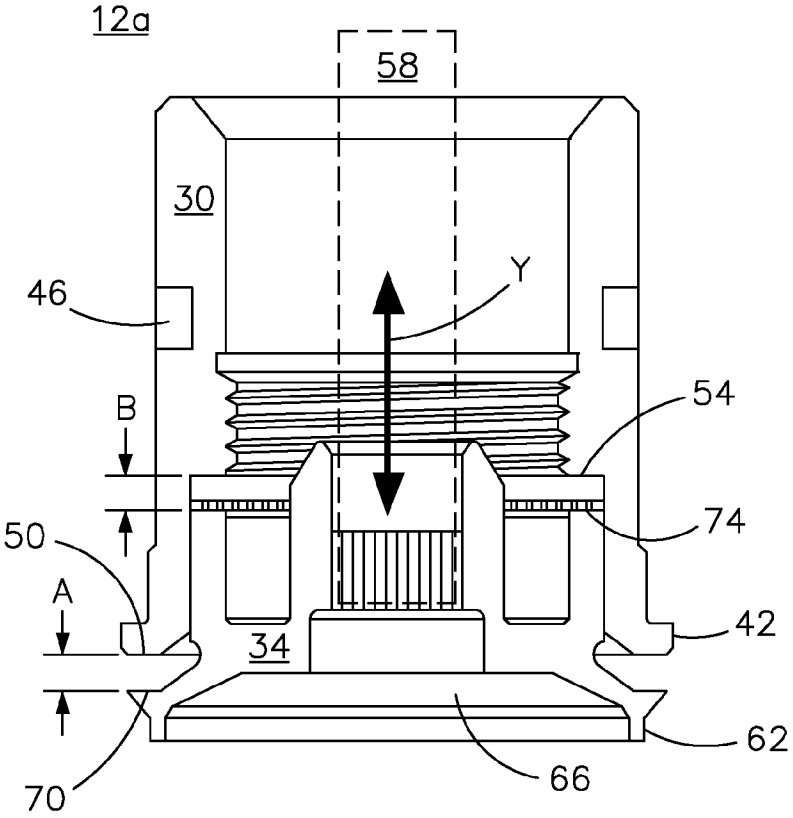
FIG. 3B is a side cross-sectional view of the chuck-knockout assembly depicted in FIG. 3A in a knockout position.
Figure 3A:
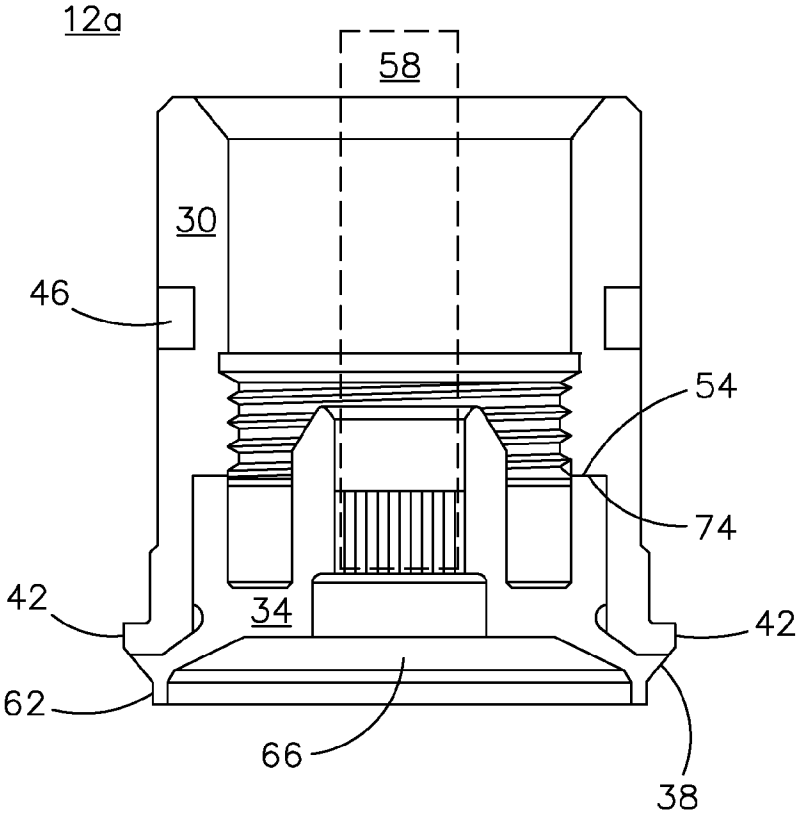
FIG. 3A is a side cross-sectional view of a chuck-knockout assembly capable of being used in the system depicted in FIG. 1.

Referring now to FIGS. 3A and 3B, a chuck-knockout assembly 12*a* may be used in a seaming system such as seaming system 10 (shown in FIG. 1). As shown, chuck-knockout assembly 12*a* includes an upper chuck body 30 and a lower chuck body 34. Upper chuck body 30 and lower chuck body 34 together at least partially define a seaming surface 38 during seaming of an end onto a container. Lower chuck body 34 also helps locate and maintain the can end prior to seaming of the can end onto the can body (i.e. during the transition zone shown in FIG. 2) and may eject or release the can end from the chuck-knockout assembly 12*a* after seaming. Chuck-knockout assembly 12*a* defines a longitudinal axis Y.

As shown in FIGS. 3A and 3B, upper chuck body 30 includes a first drive surface 42 that partially defines seaming surface 38. As shown, first drive surface 42 is approximately vertical. Upper chuck body 30 also defines one or more retainer cavities 46 that may be coupled to one or more retainers or protrusions (not shown) extending from shaft 13 or a seaming head or spindle (not shown) to affix chuck-knockout assembly 12*a* to shaft 13. In other embodiments, any other retention mechanism that is known in the art may be used to affix chuck-knockout assembly 12*a* to shaft 13. Upper chuck body 30 mates with lower chuck body 34 along an outer mating surface 50 and an inner mating surface 54.

Upper chuck body 30 may be made from any material, for example, steel or iron. Upper chuck body 30 preferably has a generally cylindrical outer shape, centered around longitudinal axis Y. Upper chuck body 30 may include an internal void (not shown) that may be configured to allow a portion of a knockout rod assembly 58 to pass through upper chuck body 30 and be affixed to lower chuck body 34.

Lower chuck body 34 includes a second drive surface 62 that may serve multiple purposes. For example, second drive surface 62 partially defines seaming surface 38 during the seaming operation. Second drive surface 62 may also locate the can end prior to the seaming operation and may serve to push against the can end to disengage or release a sealed container from chuck-knockout assembly 12*a* after seaming. Second drive surface 62 preferably has a cylindrical or frustoconical shape that may be configured to mate with corresponding peripheral features of the can end (as shown, for example, in FIGS. 4A and 4B). As shown, a portion of second drive surface 62 may extend into a countersink of the can end. Lower chuck body 34 also defines a central cavity 66 that may allow one or more radially inward features of the can end (e.g., a lift tab, a score, or an openable panel portion) to be devoid of contact with chuck-knockout assembly 12*a* during and after seaming). In this regard, the upper surface that forms cavity 66 preferably is spaced apart from the can end.

Lower chuck body 34 may be made from any material, for example, steel or iron, and may be coated or surface treated. Lower chuck body 34 preferably has a generally cylindrical outer shape, centered around longitudinal axis Y. Lower chuck body 34 may be coupled to knockout rod assembly 58 (preferably cam-actuated) which may pass through apertures in upper chuck body 30 and shaft 13 and may be coupled to seaming machine frame 11 (shown in FIG. 1).

As shown in FIGS. 3A and 3B, lower chuck body 34 may be slideable along longitudinal axis Y relative to upper chuck body 30 between a seaming position and a knockout position. Lower chuck body 34 may be substantially angularly fixed relative to upper chuck body 30 in both the seaming position and the knockout position. Lower chuck body 34 may have a substantially constant angular position about longitudinal axis Y relative to upper chuck body 30, such that upper chuck body 30 and lower chuck body 34 may rotate together about longitudinal axis Y (e.g., during seaming). To permit lower chuck body 34 to be slideable relative to upper chuck body 30 only along longitudinal axis Y, mating vertical corrugations or splines (not shown) may be provided in the outer surface of lower chuck body 34 and the inner surface of upper chuck body 30. Lower chuck body 34 may be actuated along longitudinal axis Y by the motion of knockout rod assembly 58, which preferably is cam-actuated.

When lower chuck body 34 is in the seaming position, as shown in FIG. 3A, an outer mating surface 70 of lower chuck body 34 may be in contact with or disposed proximate to corresponding outer mating surface 50 of upper chuck body 30, and an inner mating surface 74 of lower chuck body 34 may be in contact with or disposed proximate to corresponding inner mating surface 54 of upper chuck body 30.

When lower chuck body 34 is in the knockout position, as shown in FIG. 3B, outer mating surface 70 of lower chuck body 34 may be spaced apart from outer mating surface 50 of upper chuck body 30, creating an outer separation gap A, and inner mating surface 74 of lower chuck body 34 may be spaced apart from inner mating surface 54 of upper chuck body 30, creating an inner separation gap B. The distance that surfaces 50 and 70 and that surfaces 54 and 74 are spaced apart may be chosen by person familiar with seaming technology according to well-known principles upon consideration of this disclosure.

Figure 4B:
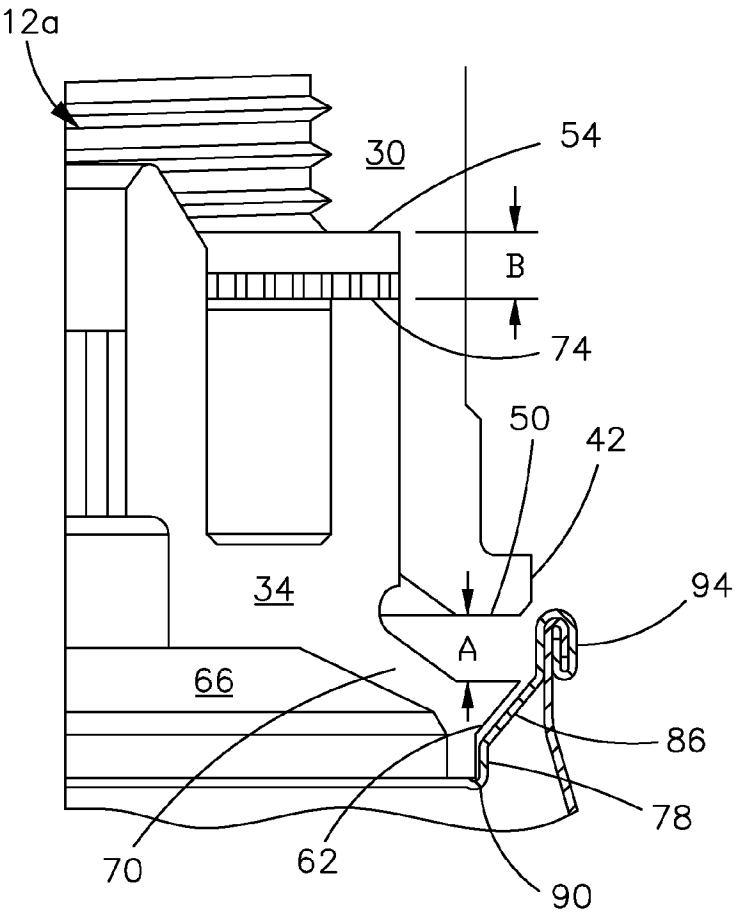
FIG. 4B is a partial side cross-sectional view of a seaming system with the chuck-knockout assembly in the knockout position as depicted in FIG. 3B.
Figure 4A:
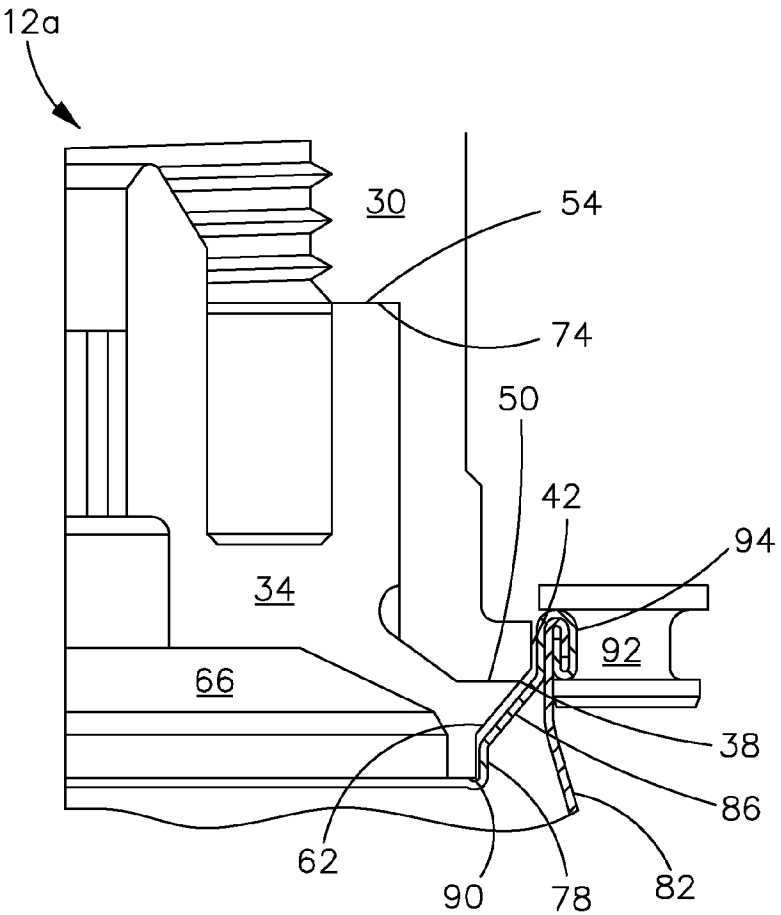
FIG. 4A is a partial side cross-sectional view of a seaming system with the chuck-knockout assembly in the seaming position as depicted in FIG. 3A.

Referring now to FIGS. 4A and 4B, chuck-knockout assembly 12*a* may be configured to engage and support corresponding features on a can end 78 during the seaming operation. For example, while in the knockout position lower chuck body 34 locates can end 78 by having second drive surface 62 engage the outer periphery (i.e., at least one of a chuck wall 86, a countersink 90, or a peripheral portion of an approximately planar center panel of can end 78 located near countersink 90 but radially outside of a pull tab or tear panel) of can end 78. Lower chuck body 34 then moves to a seaming position so that the end 78 may be seamed onto a can body 82. As shown in FIG. 4A first drive surface 42 and second drive surface 62 together define seaming surface 38 when lower chuck body 34 is in the seaming position. During seaming, seaming surface 38 serves as an anvil to support a portion of chuck wall 86 of can end 78 against the generally inwardly-directed force applied by a first seaming roll (not shown) and a second seaming roll 92 to form a double seam 94.

As a result of the seaming process, chuck wall 86 may exert a retention force (generally directed radially inward) on seaming surface 38. Also, a portion of chuck wall 86 may be partially bent around the upper corner of seaming surface 38 (i.e., can end cut-over), thereby increasing any retention force that chuck wall 86 may be exerting on seaming surface 38.

After seaming, as shown in FIG. 4A, and subsequent lowering of the lifter plate (i.e. lifter plate 16 shown in FIG. 1), lower chuck body 34 moves from its retracted position of FIG. 4A to the extended or knockout position as shown in FIG. 4B. As lower chuck body 34 moves to the knockout position the container may be ejected from chuck-knockout assembly 12*a*. To eject the container, lower chuck body 34 may be moved downward relative to upper chuck body 30, along longitudinal axis Y. Lower chuck body 34 may be moved downward by knockout rod assembly 58, which may slide through a void inside upper chuck body 30.

As lower chuck body 34 begins to move down, lower chuck body 34 may exert an ejection force on the container via second drive surface 62. Second drive surface 62 preferably pushes downward on a periphery of can end 78. The presence of cavity 66 may allow second drive surface 62 to push down on the periphery of can end 78 while being devoid of contact with one or more radially inward features of can end 78 (e.g., a lift tab, a score, or an openable panel portion). The openable panel portion, score, and/or pull tab may penetrate into cavity 66 without contacting lower chuck body 34.

As lower chuck body 34 continues to move down, the separation of outer mating surfaces 50 and 70 may begin to create outer separation gap A, and the separation of inner mating surfaces 54 and 74 may begin to create inner separation gap B. Lower chuck body 34 continues to move down until separation gap A is large enough that the retention force that a portion of chuck wall 86 exerts on seaming surface 38 becomes less than the gravitational force acting to pull the container off of chuck-knockout assembly 12*a*, at which point container 20 disengages from knockout assembly 12*a*. In some embodiments, lower chuck body 34 may continue to move down until separation gap A is greater than the height of double seam 94, thereby eliminating contact between chuck wall 86 and seaming surface 38 and enhancing disengagement or release of the container from chuck-knockout assembly 12*a*.

While not being bound by theory, it is believed that the improved aligning of second drive surface 62 with a periphery of can end 78, compared with using a conventional knockout rod, pin, or pad, may allow for a more controlled can handling, which may reduce seaming process time and reduce potential damage to seamed containers. For example, having an increased controllability of the can end while the can end is being located and increased stability of the container during ejection from chuck-knockout assembly 12*a* may help prevent the container from crushing or creasing during and after the seaming operation.

In this regard, after a container 20 is ejected from chuck-knockout assembly 12*a*, lower chuck body 34 preferably contacts and locates another, incoming can end while lower chuck body 34 is in the extended, knockout position. Lower chuck body 34 then moves upwards relative to upper chuck body 30 along longitudinal axis Y, reestablishing contact between outer mating surfaces 50 and 70 and inner mating surfaces 54 and 74 and eliminating the separation gaps A and B. When chuck-knockout assembly 12*a* has returned to the seaming position, the double seaming process may be repeated, whereby a double seam may be created on a new container.

Figure 5:
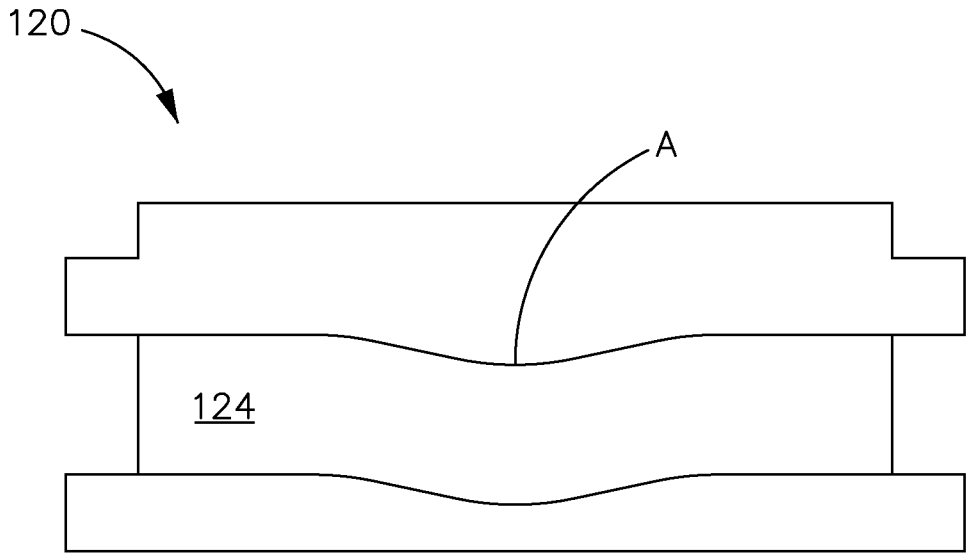
FIG. 5 is a side view of a cam for actuating a knockout.

Lower chuck body may be actuated using a cam. As the lower chuck body is actuated in a downward direction, and once the lower chuck body has located a can end, a vertical load may be applied to the can end to thereby hold the can end onto the can body. Preferably the load remains sufficient at least during the transition zone, as explained more fully below. FIG. 5 shows an example cam that may be used to actuate the lower chuck body. As shown, a cam 120 includes a path 124. As the chuck-knockout completes an operation, the cam profile will cause the lower chuck body to actuate.

Figure 6:
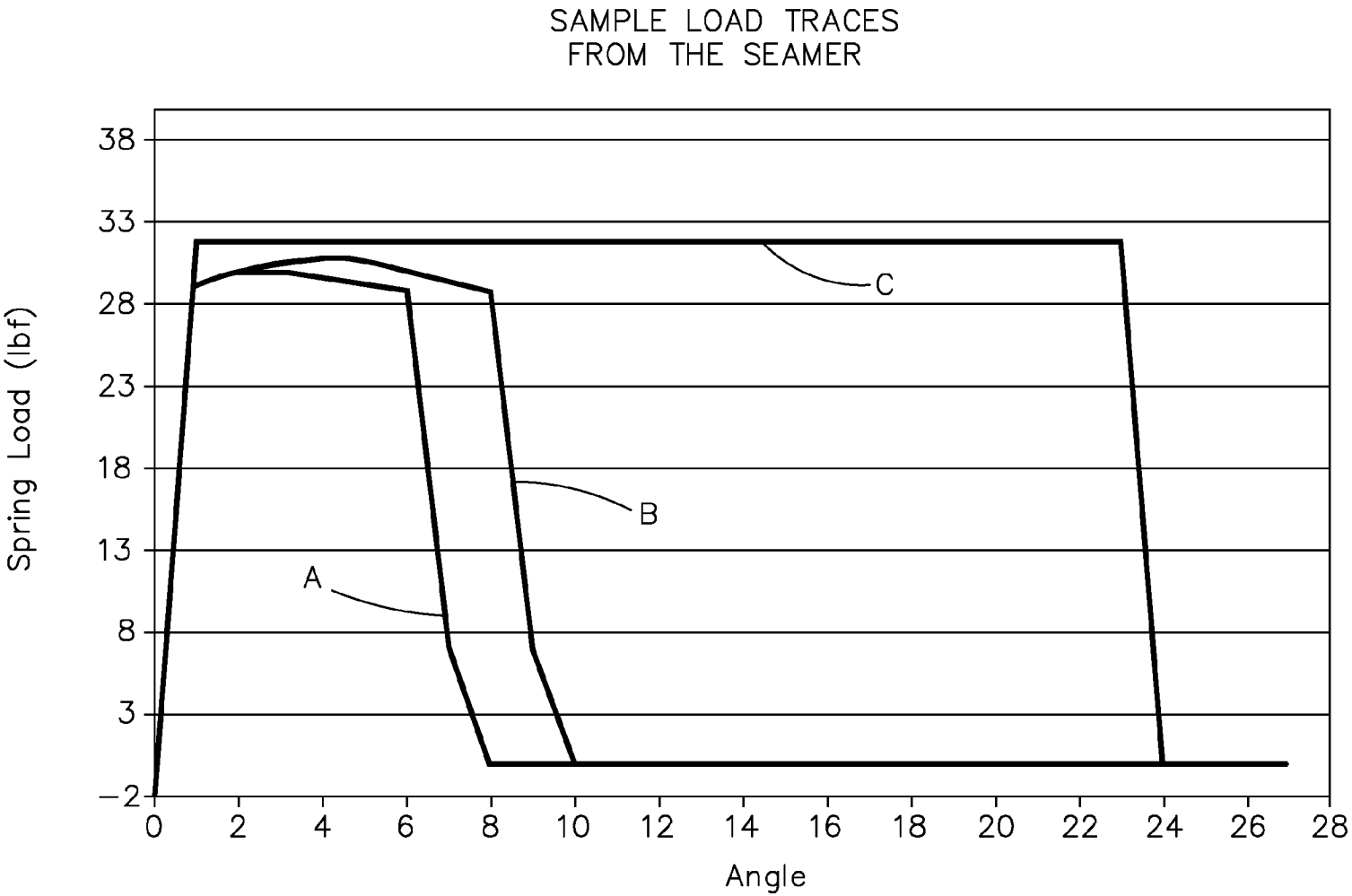
FIG. 6 is a graph showing the loads applied to a can end during at least a transition stage of the seaming operation.

By using a chuck-knockout assembly having some or all of the features described, a sufficient compressive load may be applied to the can end and can body combination during at least a majority of the transition zone of the seaming operation. Preferably the compressive load is applied during the entire transition zone. FIG. 6 is a graph that shows the loads applied to the can end and can body combination for three different knockout and lifter plate combinations. As shown, for combinations A and B which use a standard rise knockout and soft rise knockout respectively, a sufficient clamping load is applied for a portion of the transition period and then at about an angle of 6 or 9 degrees the clamping load decreases substantially. However, for combination C which includes a chuck-knockout assembly utilizing at least some of the features described herein, an adequate clamping load is applied for at least 70% of the transition zone, preferably at least 85% of the transition zone, and even more preferably at least 100% of the transition zone. As shown, the clamping load for combination C is sufficient for the entire transition zone. Preferably, for the commercial 12 ounce aluminum beverage cans, the load is between 15 and 100 lbf, more preferably the load is between 30 and 38 lbf, and even more preferably the about 35 lbf. By applying a load that is sufficient to the can end and can body combination, certain seamers may be operated at higher speeds with less damage occurring to the can end and/or can body. Sufficient load for other applications may be chosen according to the present disclosure based on parameters particular to the application.

Other embodiments of a chuck-knockout assembly that can improve the locating of the can end are envisioned. For example, the improved location may be achieved by locating off of another feature of the end such as off of the rivet or some other feature of the can end.

Figure 7:
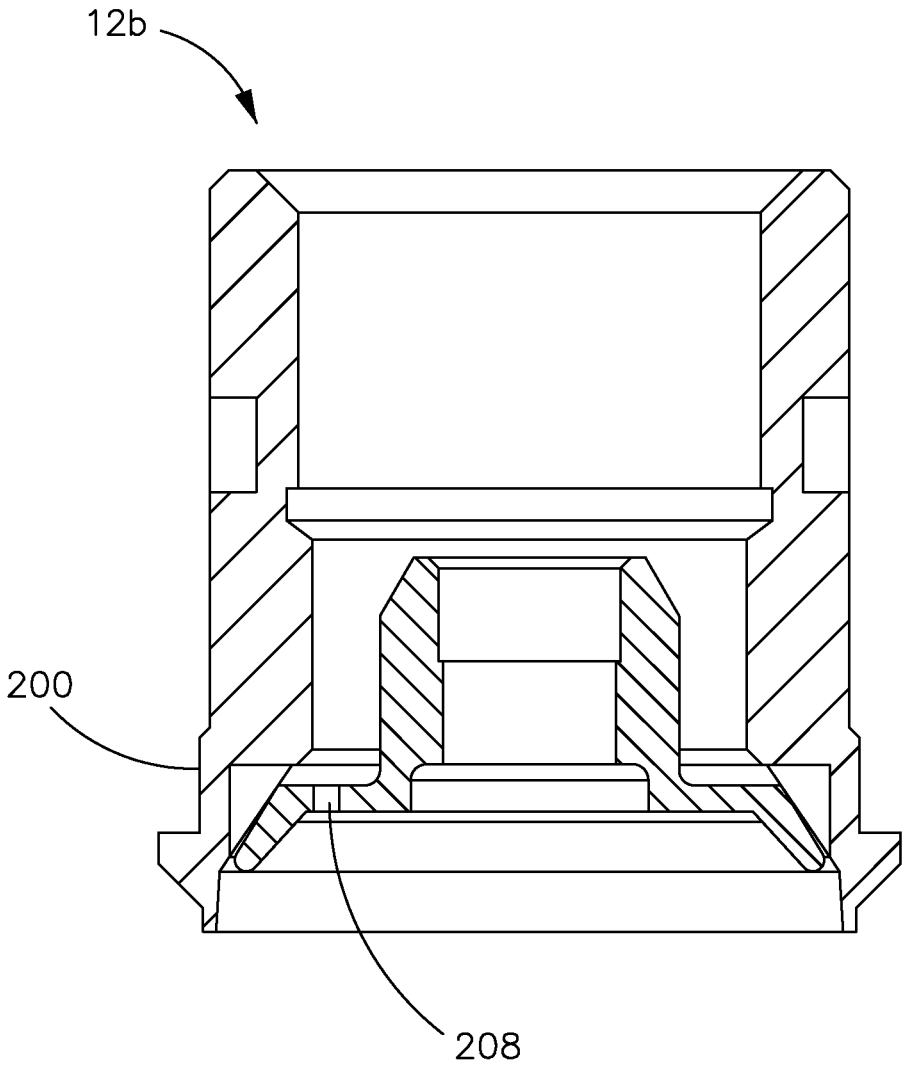
FIG. 7 is a side cross-sectional view of another chuck-knockout assembly capable of being used in the system depicted in FIG. 1.

Furthermore, the chuck-knockout assembly may include structures to help reduce or help create vacuum forces. For example a chuck-knockout assembly that utilizes such a feature is shown in FIG. 7. As shown, a chuck-knockout assembly 12*b* includes a chuck body 200 having an aperture 208 formed in the lower body of the chuck-knockout assembly. A vacuum manifold may be in communication with aperture 208 such that the vacuum may be controlled. The vacuum may be employed and the can end may be located via the vacuum through aperture 208. It should be understood that the vacuum force may also be used with chuck-knockout assembly 12*a*. Alternatively vent hole 208 may be adapted to release trapped air when the chuck-knockout assembly 12*b* contacts the can end. By allowing air to escape vacuum created by the trapped air will be diminished to thereby make it easier to release the can after the seaming operation is complete.

The figures illustrate assemblies 12*a* and 12*b* employed with an end shown in U.S. Pat. No. 6,065,634. The present invention is not limited to use with this particular can end. For example, the present invention encompasses employing the apparatus and methods described herein with the ends shown in U.S. Pat. Nos. 6,702,142, 6,516,968 and 7,350,392 or their commercial embodiments. The disclosures of each of these patents are incorporated herein in their entireties. Moreover, the present invention is not limited to use with beverage containers. The particular configuration of the chuck-knockout assembly for these and other ends will be clear to persons familiar with these other can end configurations. For example, the second drive surface may include a curved portion that drives in or proximate to a knee or junction between can end chuck wall portions in circumstances in which the end chuck wall is a multiple-part chuck wall.

The foregoing description is provided for the purpose of explanation and is not to be construed as limiting the invention. While the invention has been described with reference to preferred embodiments or preferred methods, it is understood that the words which have been used herein are words of description and illustration, rather than words of limitation. Furthermore, although the invention has been described herein with reference to particular structure, methods, and embodiments, the invention is not intended to be limited to the particulars disclosed herein, as the invention extends to all structures, methods and uses that are within the scope of the appended claims. Those skilled in the relevant art, having the benefit of the teachings of this specification, may effect numerous modifications to the invention as described herein, and changes can be made without departing from the scope and spirit of the invention as defined by the appended claims. Furthermore, any features of one described embodiment can be applicable to the other embodiments described herein.

What is claimed:

1. A method of seaming a can end onto a can body to form a container, the method comprising:

positioning the can end on top of the can body to form a can body and can end combination;

locating the can end with a chuck-knockout assembly;

lifting the can body and can end combination until the can end is engaged with a chuck body of the chuck-knockout assembly to thereby position the can body and can end combination in a seaming position;

maintaining a load that is between 15 and 100 lbf on the can body and can end combination for at least a majority of a transition zone that begins when the can end is located by the chuck-knockout assembly and ends when the can end engages the chuck body and is in the seaming position; and seaming the can end onto the can body during a first seaming operation.

2. The method of claim 1 wherein the chuck-knockout assembly further comprises a lower chuck body and the can end is located by the lower chuck body such that a drive surface of the lower chuck body is in contact with the can end during the transition zone.

3. The method of claim 2 further comprising translating the lower chuck body into an engaging position after the can end has been located by the lower chuck body, wherein a drive surface of the upper chuck body and the drive surface of the lower chuck body together at least partially define a seaming surface when the lower chuck body is in the engaging position.

4. The method of claim 2 further comprising translating the lower chuck body into a knockout position before the can end is located by the lower chuck body.

5. The method of claim 1 wherein the load is maintained between 30 lbf and 38 lbf.

6. The method of claim 1 wherein the load is maintained at 35 lbf.

7. The method of claim 1 wherein the load is maintained for at least 85% of the transition zone.

8. The method of claim 1 wherein the load is maintained at least until the can body and can end have engaged an upper chuck body of the chuck-knockout assembly.

9. The method of claim 1 wherein the load is maintained for at least 70% of the transition zone.

10. The method of claim 1 wherein the load is maintained for 100% of the transition zone.

11. The method of claim 1 wherein the locating step includes using a vacuum.

12. The method of claim 1 wherein the locating step includes locating in relation to a feature of the can end.

13. The method of claim 12 wherein the locating step includes locating in relation to a rivet on the can end.

14. The method of claim 1 further comprising releasing the can after the seaming step is complete.

15. The method of claim 11 further comprising releasing the can after the seaming step is complete wherein the releasing step includes allowing air to escape the vacuum.

16. A method of seaming a can end onto a can body to form a container, the method comprising:

positioning the can end on top of the can body to form a can body and can end combination;

locating the can end with a knockout;

engaging the can end with a chuck such that the can end can be seamed to the can body;

maintaining a load that is between 15 and 100 lbf on the can body and can end combination for at least a majority of the transition zone, wherein the transition zone begins when the can end is located by the knockout and ends when the can end engages the chuck and is in a seaming position; and seaming the can end onto the can body.

17. The method of claim 16, wherein the seaming step further includes engaging a first seaming roll and a second seaming roll with the can body and can end combination.

18. The method of claim 16, further comprising releasing the can end from the chuck.

19. The method of claim 16, wherein the engaging step includes engaging the can end with a drive surface of the knockout.

20. The method of claim 19, further comprising releasing the can end from the chuck with the drive surface of the knockout.

* * * * *